US005384514A

United States Patent [19]

Kim

[11] Patent Number: 5,384,514

[45] Date of Patent: Jan. 24, 1995

[54] PLASMA DISPLAY DEVICE

[75] Inventor: Dae-il Kim, Suwon, Rep. of Korea

[73] Assignee: Samsung Electron Devices Co., Ltd., Kyunggi-do, Rep. of Korea

[21] Appl. No.: 753,045

[22] Filed: Aug. 30, 1991

[30] Foreign Application Priority Data

Sep. 7, 1990 [KR] Rep. of Korea ..... 90-14149

[51] Int. Cl.[6] ..... H01J 17/49

[52] U.S. Cl. ..... 313/585; 313/584

[58] Field of Search ..... 313/585, 584, 485

[56] References Cited

U.S. PATENT DOCUMENTS 3,934,172 1/1976 Okamoto ..... 313/485 X
4,060,749 11/1977 Shinada et al. ..... 313/585 X
4,423,352 12/1983 Miyazaki et al. ..... 313/584
5,041,759 8/1991 Kwon et al. ..... 313/585 X

FOREIGN PATENT DOCUMENTS 193234 10/1985 Japan ..... 313/584

*Primary Examiner*—Michael Horabik
*Attorney, Agent, or Firm*—Leydig, Voit & Mayer

[57] ABSTRACT

A direct current type plasma display device includes an auxiliary discharge cell which has barrier walls for preventing cross-talk. First and second barrier walls are provided on front and rear plates respectively. The first and second barrier walls are in contact with each other and skewed by a predetermined width. A third barrier wall is integrally formed with the first barrier wall in a perpendicular direction to the first barrier wall. Thus, practical application is easy, and the plasma display device can effectively improve cross-talk suppression as well as the degree of contrast. This device can be applied to both monochrome and color systems and is particularly useful in large scale image reproducing apparatus requiring a high degree of image quality.

6 Claims, 2 Drawing Sheets

PLASMA DISPLAY DEVICE

BACKGROUND OF THE INVENTION

The present invention relates to a plasma display device and more particularly to an auxiliary discharge type direct current type plasma display device.

Generally, in a DC PDP (DC type Plasma Display Panel), an auxiliary discharge method is applied to induce a fast and stable discharge. In an auxiliary discharge type plasma display device, an auxiliary discharge is brought about before the main discharge occurs so that the main discharge easily takes place with the help of the charged particles formed by the auxiliary discharge.

FIG. 1 pictorially shows a conventional DC PDP of auxiliary discharge type.

A plurality of grooves 11 and 21 are opposed to each other in parallel on the inner surfaces of front plate 10 and rear plate 20 having a specified interval. A thread-like anode 12 is inserted into the multiple grooves 11 of the front plate 10, and an auxiliary anode 22 is inserted into the multiple grooves 21 of the rear plate 20 which is opposite to the front plate. A plurality of stripe-like cathodes 24 are arrayed perpendicularly to multiple grooves 21 on the inner surface of the rear plate 20. A plurality of pierced holes 25 are formed at proper intervals in each cathode opposite to the lower portion of grooves 21. The conventional PDP causes an auxiliary discharge between a cathode 24 and an auxiliary anode 22 arrayed in the form of an X-Y matrix on the rear plate 20, and supplies the charged particles generated from the auxiliary discharge to the main discharge region between the cathode 24 and the anode 12 through the pierced holes 25 of cathode 24. Since the charged particles supplied to the main discharge region are in the state of being supplied between the anode 12 and cathode 24, it helps the main discharge between the anode 12 and the cathode 24 to take place easily at a high speed.

Since the above conventional PDP is structured in such a way that the auxiliary discharge light cannot be transmitted to the front plate, contrary to other PDP's of different types of auxiliary discharge, it has a characteristic of having a high degree of contrast. However, it has a complexity of structure because the grooves having a specified depth must be formed where an anode and an auxiliary anode are inserted in the front plate and the rear plate. As a result, this complexity of structure reduces product productivity, and is a primary factor in obstructing mass-production, thereby making the product's practicability difficult to attain.

SUMMARY OF THE INVENTION

A principal object of the present invention is to provide a plasma display panel having a high degree of contrast.

Another object of the present invention is to provide a plasma display panel which can be easily manufactured.

Yet another object of the present invention is to provide a plasma display panel suitable for full color type application.

To achieve the objects, the plasma display panel of the present invention comprises:

a front plate and a rear plate spaced apart from each other by a specified close interval;

a plurality of stripe-like anodes and cathodes arranged in the form of an X-Y matrix on each inner surface of the front and rear plates;

a barrier wall means serving as a cross-talk preventing means and having a first barrier wall of a specified height positioned on the front plate surface, a second barrier wall formed on the rear plate surface in the same direction as that of the first barrier wall and a part of whose upper edge portion is in contact with the lower edge portion of the first barrier wall and skewed by a specified width so as to be offset, and a third barrier wall as a means for preventing cross-talk constituting a lattice in conjunction with the first barrier wall by being formed to have the same height as and a direction perpendicular to the first barrier wall; and a plurality of stripe-like auxiliary anodes positioned in the same direction as the anodes on the lower edge portion of the first barrier wall that are not in contact with the upper edge portion of the second barrier wall.

A phosphor material of a specified color can be coated on the side surface of the first and third barrier walls which constitute a pixel, i.e., enclose one discharge path in a color PDP. In the color PDP as constructed in the above described manner, since the phosphor material is positioned near the anode where ion impact is not so great, the lifetime of the phosphor material is lengthened and of course, visible light having a high degree of luminance can be produced.

The plasma display device of the present invention has a detoured discharge path that is approximately in the shape of a 'Z' due to the first and second barrier walls which are skewed by a specified amount. The auxiliary anode is disposed in the discharge region between the cathode and main anode, so that all of the charged particles brought about in the auxiliary discharge contribute to the main discharge. A part of the auxiliary discharge region is also shielded by a first barrier wall, so that the transmission of the auxiliary discharge light onto the front plate surface is inhibited and the degree of contrast of the image is improved. Moreover, the first and the third barrier walls are formed in a lattice shape, so that the unit discharge spaces are completely isolated so that it is possible to completely inhibit the cross-talk. Furthermore, the structure is simplified compared to that of the conventional one so that it can be mass produced while reducing the rate of defective products.

BRIEF DESCRIPTION OF THE DRAWINGS

The above objects and other advantages of the present invention will become more apparent by describing the preferred embodiment of the present invention with reference to the attached drawings, in which.

DETAILED DESCRIPTION OF THE INVENTION

Figure 1:
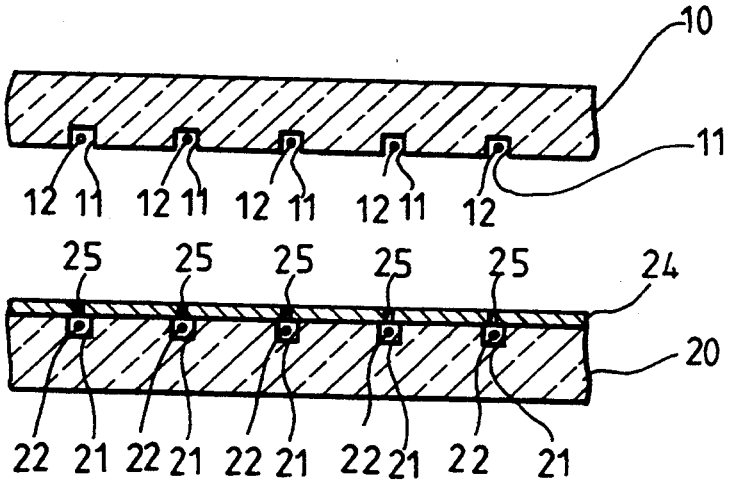
FIG. 1 (PRIOR ART)
FIG. 1 is a pictorial cross-sectional view of a conventional plasma display device.
Figure 2:
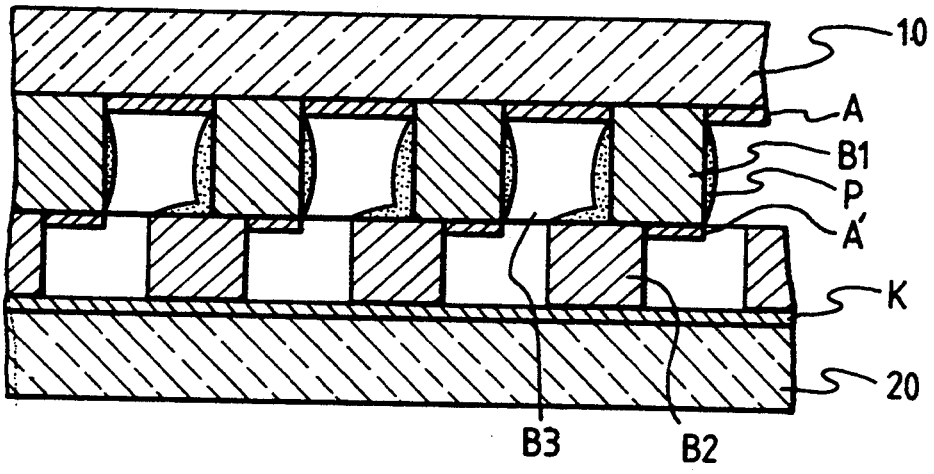
FIG. 2 is a pictorial cross-sectional view of the plasma display device according to the present invention.
Figure 3:
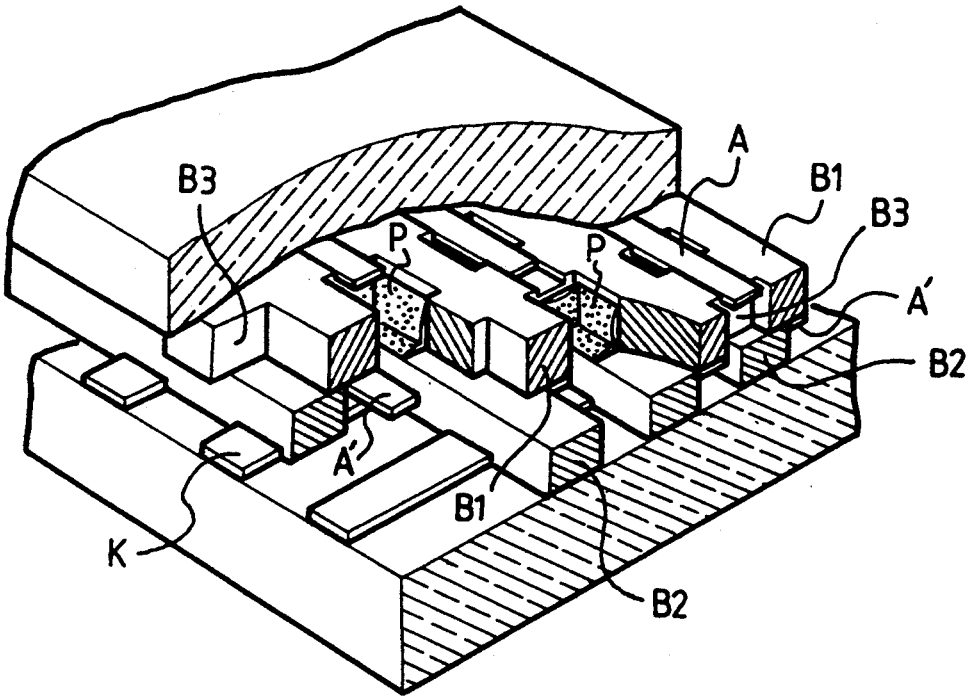
FIG. 3 is a cut-away extracted perspective view of the plasma display device according to the present invention.

The plasma display device of the present invention has the structure shown in FIGS. 2 and 3.

A plurality of anodes A and cathodes K in the form of stripes are arranged in a crossed fashion to form an X-Y matrix on each of the inner surfaces of front plate 10 and rear plate 20 maintaining a specified interval. A first barrier wall B1 and a second barrier wall B2 whose lower and upper edge portions are in contact with each other and mutually skewed are arranged between front plate 10 and rear plate 20. The first barrier wall B1 and a third barrier wall B3 which is perpendicular in direction to the first barrier wall B1 constitute one sheet where plurality of square holes are formed in a matrix. The first and third barrier walls are disposed on the front plate surface 10 and the second barrier wall B2 on the rear plate surface 20. A portion of first barrier wall B1 and second barrier wall B2 are in contact with each other, thereby constituting a unit barrier wall in parallel to the anode A. Since both barrier walls are off-set by a specified width (approximately a half of the depth of the barrier), the discharge path between them forms an approximate Z shape. The auxiliary anode A', which causes an auxiliary discharge to occur before the main discharge, is arranged in the same direction as that of the main anode A and is formed in parallel with and on the lower edge surface of the first barrier wall B1 where the upper edge surface of second barrier wall B2 is not in contact, so that it faces the cathode. When necessary, a phosphor P of a specified color is coated onto the inner walls of the space formed by the first barrier wall B1 and the third barrier wall B3. This is for the case of a color type PDP.

Such a plasma display device of the present invention has a discharge path (region) in the shape of a Z with a second barrier wall B2 formed askew to the first barrier wall B1 by a specified width from the second barrier wall B2. The first barrier wall B1 encloses a hexahedral space providing each discharge path in cooperation with the third barrier wall B3 formed in a direction perpendicular to the first barrier wall B1. Accordingly, the auxiliary discharge occurs between the auxiliary anode positioned on the lower edge surface of first barrier wall B1 and the cathode K disposed on the rear plate, and the main discharge takes place through the curved path. So, the auxiliary discharge, regardless of image display, is shielded by the first barrier wall so that it does not deteriorate the contrast of the main discharge which contributes to the actual image display. In a color PDP, by coating a phosphor on the side wall of first barrier wall disposed near the anode, the luminescence of a specified color is attained by ultraviolet rays which are absorbed by the phosphor, and since the periphery of the anode is enclosed by first barrier wall and third barrier wall, concern about cross-talk is eliminated. Moreover, since an auxiliary discharge region is included in the main discharge region, all of the charged particles obtained through the auxiliary discharge contribute to the main discharge through the auxiliary discharge. Compared to the conventional plasma display device, since the main discharge occurs very easily, the intensity of the auxiliary discharge can be reduced to the maximum limit. The plasma display device of the present invention is also simpler in structure than that of conventional one, so that mass-production is possible and the rate of defective product production is lowered remarkably.

The above described embodiment of the present invention was explained being limited to a very simple structure, but actually, it is further preferred that it be applied to a very complex image display devices and more particularly, to high density image display devices. It is inevitable that any type plasma display device, without departing from the basic technical idea of the present invention, is within the scope of the present invention regardless of being a black and white type or a natural color type.

What is claimed is:

1. A plasma display panel comprising:

a front plate including an inner surface;

a rear plate spaced apart from said front plate having an inner surface facing the inner surface of said front plate;

a plurality of stripe-like anodes arranged in parallel on the inner surface of said front plate;

a plurality of stripe-like cathodes disposed on the inner surface of said rear plate and arranged parallel to each other and perpendicular to the stripe-like anodes;

a plurality of elongated first barrier walls disposed on the inner surface of said front plate parallel to said stripe-like anodes, each wall having a lower edge and a pair of side edges, and each wall being located between adjacent stripe-like anodes;

a plurality of elongated second barrier walls disposed on said rear plate parallel to said first barrier walls and crossing said cathodes, each wall having an upper edge and a pair of side edges, said first elongated barrier walls being stacked on said second elongated barrier walls in a skewed fashion such that the side edges of said first and second barrier walls are out of alignment and the lower edge of said first barrier wall and the upper edge of said second barrier wall are partially exposed;

a plurality of third elongated barrier walls disposed on said front plate forming a lattice structure in conjunction with said first barrier walls; and a plurality of stripe-like auxiliary anodes each disposed on a lower edge of one of said plurality of first elongated barrier walls such that an auxiliary discharge space is formed between one of said plurality of cathodes, an auxiliary anode and one of said second elongated barrier walls.

2. A plasma display panel as claimed in claim 1, wherein said first and third elongated barrier walls are integrally formed to define a plurality of pierced through holes in an X-Y matrix.

3. A plasma display panel as claimed in claim 1, wherein a phosphor material of a specified color is coated on the side surfaces of said first and third elongated barrier walls.

4. A plasma display panel comprising:

a front plate;

a rear plate facing said front plate and spaced from said front plate by a predetermined distance;

a plurality of strip-like anodes disposed on a surface of said front plate arranged in parallel;

a plurality of stripe-like cathodes disposed on a surface of said rear plate facing said stripe-like anodes and arranged perpendicular to said stripe-like anodes;

a plurality of first barrier walls of a specified height disposed on said front plate, each of said first barrier walls being arranged between stripe-like anodes and each of said first barrier walls having a lower edge portion which faces said rear plate;

a plurality of second barrier walls disposed on said rear plate arranged parallel to said first barrier walls, each of said second barrier walls having an upper edge which faces said front plate and which is contiguous to a lower edge of one of said first barrier walls and offset by a specified width providing a Z-shaped discharge path;

a plurality of third barrier walls disposed on said front plate forming a lattice structure with said first barrier walls for preventing cross-talk; and a plurality of stripe-like auxiliary anodes disposed on offset portions of the lower edges of said first barrier walls and arranged parallel to said stripe-like anodes.

5. A plasma display panel as claimed in claim 4, wherein said first and third elongated barrier walls are integrally formed to define a plurality of pierced through holes in an X-Y matrix.

6. A plasma display panel as claimed in claim 4, wherein a phosphor material of a specified color is coated on the side surfaces of said first and third elongated barrier walls.

* * * * *